US010054284B2

(12) United States Patent
Mun

(10) Patent No.: US 10,054,284 B2
(45) Date of Patent: Aug. 21, 2018

(54) LIGHTING APPARATUS FOR VEHICLE

(71) Applicant: HYUNDAI MOBIS Co., Ltd., Yongin-si, Gyeonggi-do (KR)

(72) Inventor: Jun Hee Mun, Yongin-si (KR)

(73) Assignee: HYUNDAI MOBIS Co., Ltd., Yongin-si (KR)

( * ) Notice: Subject to any disclaimer, the term of this patent is extended or adjusted under 35 U.S.C. 154(b) by 395 days.

(21) Appl. No.: 15/049,924

(22) Filed: Feb. 22, 2016

(65) Prior Publication Data

US 2016/0245476 A1 Aug. 25, 2016

(30) Foreign Application Priority Data

Feb. 25, 2015 (KR) ..... 10-2015-0026256

(51) Int. Cl.

| | |
|---|---|
| ***H01J 1/52*** | (2006.01) |
| ***H01J 5/02*** | (2006.01) |
| ***F21S 8/10*** | (2006.01) |
| ***F21S 41/19*** | (2018.01) |
| ***F21S 41/17*** | (2018.01) |
| ***F21S 45/00*** | (2018.01) |
| *F21V 23/00* | (2015.01) |
| *F21V 25/00* | (2006.01) |
| *F21S 41/255* | (2018.01) |
| *F21S 41/32* | (2018.01) |
| *F21S 41/689* | (2018.01) |

(52) U.S. Cl.

CPC ..... *F21S 48/30* (2013.01); *F21S 41/17* (2018.01); *F21S 41/198* (2018.01); *F21S 45/00* (2018.01); *F21S 41/255* (2018.01); *F21S 41/321* (2018.01); *F21S 41/689* (2018.01); *F21V 23/00* (2013.01); *F21V 25/00* (2013.01)

(58) Field of Classification Search

CPC ..... F21V 23/00–23/06; F21V 25/00–25/125; F21S 41/19–41/198; F21S 41/40–41/47; F21S 45/00–45/70; H01J 29/003; H01J 2229/0015; H01J 29/867; H01T 13/05

USPC ..... 315/85, 8; 313/313; 250/515.1

See application file for complete search history.

(56) References Cited

FOREIGN PATENT DOCUMENTS

KR 10-2015-0093513 A 8/2015

OTHER PUBLICATIONS

Jul. 18, 2017, Korean Office Action for related KR application No. 10-2015-0026256.

*Primary Examiner* — Alexander H Taningco
*Assistant Examiner* — Christian L Garcia
(74) *Attorney, Agent, or Firm* — Paratus Law Group, PLLC

(57) ABSTRACT

The present invention relates to a lighting apparatus for a vehicle, including: a bulb which generates light; a socket in which the bulb is mounted; a reflector which has a socket coupling unit to which the socket is coupled, allows the bulb to be inserted into the reflector, and reflects forward light generated by the bulb; and an electromagnetic shield which is disposed between the socket and the socket coupling unit, and has a bulb through hole which the bulb penetrates, in which first ground contact protrusions, which protrude toward a center of the bulb through hole and come into ground contact with the socket and the socket coupling unit, are formed on a portion of the electromagnetic shield where the bulb through hole is formed.

10 Claims, 8 Drawing Sheets

LIGHTING APPARATUS FOR VEHICLE

CROSS-REFERENCE TO RELATED APPLICATIONS

The present application claims priority to Korean Patent Application Number 10-2015-0026256 filed Feb. 25, 2015, the entire contents of which the application is incorporated herein for all purposes by this reference.

TECHNICAL FIELD

The present invention relates to a lighting apparatus for a vehicle, and more particularly, to a lighting apparatus for a vehicle which is provided with an electromagnetic shield between a socket coupling unit and a socket to block electromagnetic waves.

BACKGROUND

In general, headlamps are installed at a front side of a vehicle, and the vehicle travels in a state in which the headlamps installed at both sides of the front side of the vehicle are turned on because a visual range becomes significantly shorter when the vehicle travels at night than a visual range when the vehicle travels during the day time.

Meanwhile, a bulb, which serves as a light source, also generates electromagnetic waves when the bulb emits light. In a case in which the bulb is a high intensity discharge (HID) bulb, a magnitude of the electromagnetic waves, which are generated together with light, is increased together with intensity of light which is generated by high voltage to emit light with high intensity. In a case in which a magnitude of the electromagnetic wave generated from an optical system module is large when the optical system module is used as a headlamp for a vehicle, the electromagnetic wave, which leaks from the optical system module, interferes with an electronic control unit (ECU) of the vehicle, which causes various types of problems such as a problem that an engine is turned off while the vehicle travels, rattling of the engine, rpm instability, and instability of an instrument panel.

To solve the aforementioned problems, the headlamp for a vehicle in the related art is provided with an electromagnetic shield ring having a ring shape, but there are problems in that fixed costs are incurred due to a manufacturing method, and because the electromagnetic shield ring is assembled to the bulb by being fitted with the bulb, the electromagnetic shield ring is easily withdrawn when the bulb is replaced. In addition, a large number of ground contact points cannot be ensured due to the shape of the headlamp, and as a result, there is a limitation in blocking the electromagnetic wave.

SUMMARY

The present invention has been made in an effort to provide a lighting apparatus for a vehicle.

The present invention has also been made in an effort to effectively shield electromagnetic waves, easily assemble a lighting apparatus, and prevent an electromagnetic shield from being withdrawn when a bulb is replaced.

Technical problems of the present invention are not limited to the aforementioned technical problems, and other technical problems, which are not mentioned above, may be clearly understood by those skilled in the art from the following descriptions.

An exemplary embodiment of the present invention provides a lighting apparatus for a vehicle, including: a bulb which generates light; a socket in which the bulb is mounted; a reflector which has a socket coupling unit to which the socket is coupled, allows the bulb to be inserted into the reflector, and reflects forward light generated by the bulb; and an electromagnetic shield which is disposed between the socket and the socket coupling unit, and has a bulb through hole which the bulb penetrates, in which first ground contact protrusions, which protrude toward a center of the bulb through hole and come into ground contact with the socket and the socket coupling unit, are formed on a portion of the electromagnetic shield where the bulb through hole is formed.

The electromagnetic shield may include: a front portion which has the bulb through hole; and a side portion which is bent rearward from a circumference of the front portion.

Second ground contact protrusions, which come into ground contact with a side surface of the socket, may be further formed on the side portion.

The front portion may be formed in a quadrangular shape, and the side portion may include: an upper portion which is disposed at an upper side of the front portion; and a lower portion which is disposed at a lower side of the front portion.

The front portion may be formed in a quadrangular shape, and the side portion may include: a left portion which is disposed at a left side of the front portion; and a right portion which is disposed at a right side of the front portion.

The front portion may be formed in a quadrangular shape, and the side portion may include: an upper portion which is disposed at an upper side of the front portion; a lower portion which is disposed at a lower side of the front portion; a left portion which is disposed at a left side of the front portion; and a right portion which is disposed at a right side of the front portion.

The socket coupling unit may include: a case portion into which the socket is inserted and coupled and which has a bulb insertion hole into which the bulb is inserted; and a ground contact portion which protrudes rearward inside the case portion, has the bulb insertion hole formed therein, and comes into ground contact with the first ground contact protrusions.

Hook grooves may be formed in an inner surface of the case portion, and hook protrusions, which are coupled to the hook grooves, may be formed on an outer surface of the socket.

Guide bars, which are bent from the rear side toward the front side and form slots between the guide bars and an outer surface of the side portion, may be formed on the side portion, and a rim of the case portion may be inserted into the slots, such that the electromagnetic shield is coupled to the case portion.

The first ground contact protrusions may include: a first ground contact portion which comes into ground contact with the ground contact portion; and a second ground contact portion which is spaced rearward apart from the first ground contact portion and comes into ground contact with a front surface of the socket.

The second ground contact portion may be spaced apart from the first ground contact portion.

Other detailed matters of the exemplary embodiment are included in the detailed description and the drawings.

According to the lighting apparatus for a vehicle according to the present invention, there are one or more effects as follows.

First, it is possible to improve an effect of inhibiting electromagnetic waves by increasing the number of ground contact points of the electromagnetic shield.

Second, it is possible to simplify processes by omitting a process of fitting the electromagnetic shield during a process of assembling the bulb.

Third, it is possible to reduce costs by omitting coiling and spot welding processes which are technologies in the related art.

The effects of the present invention are not limited to the aforementioned effects, and other effects, which are not mentioned above, will be clearly understood by those skilled in the art from the claims.

DETAILED DESCRIPTION

Figure 1:
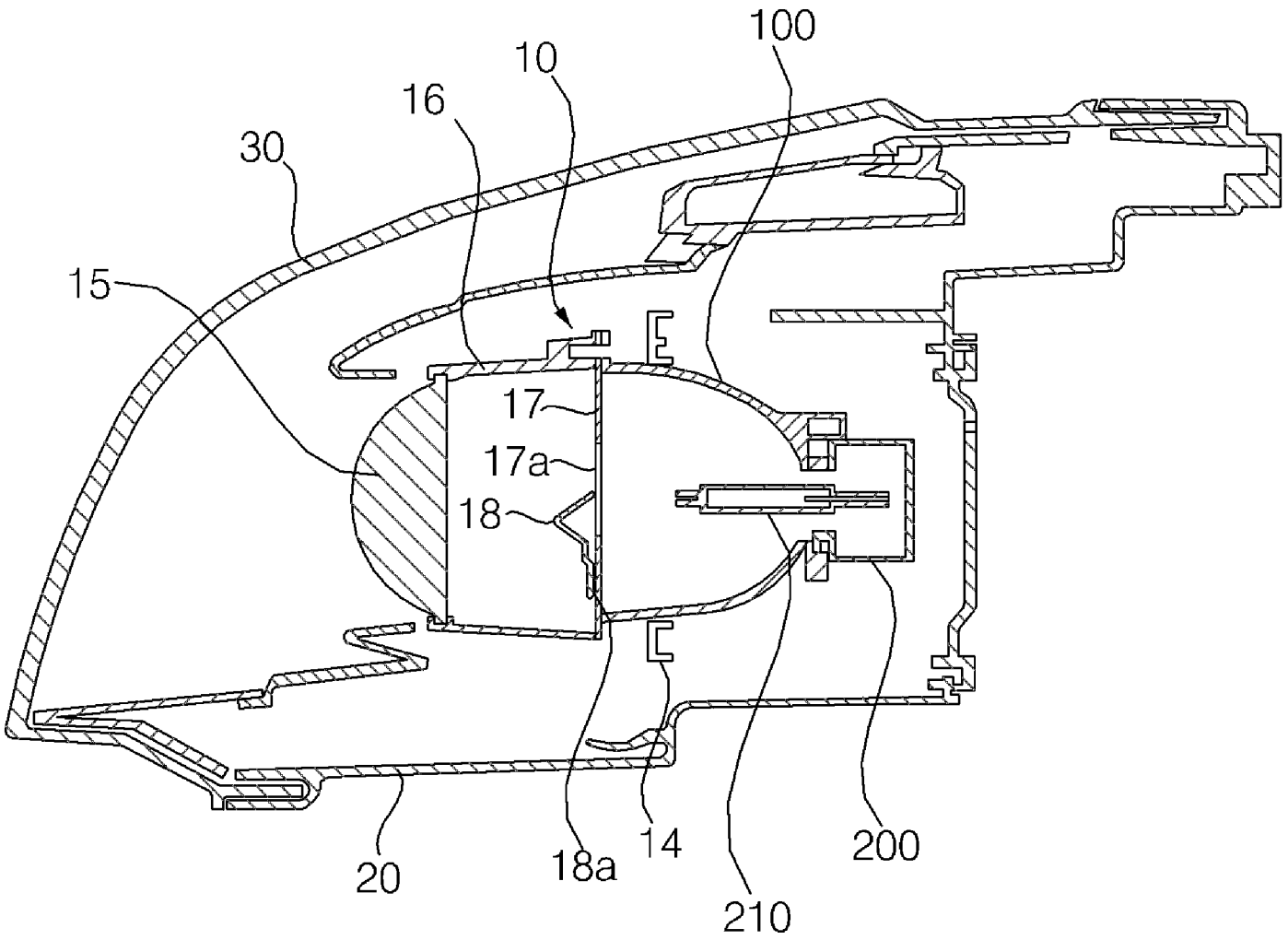
FIG. 1 is a cross-sectional side view illustrating a state in which a headlamp for a vehicle according to the present invention operates in a low-beam mode.

Advantages and features of the present invention and methods of achieving the advantages and features will be clear with reference to exemplary embodiments described in detail below together with the accompanying drawings. However, the present invention is not limited to the exemplary embodiments set forth below, and may be embodied in various other forms. The present exemplary embodiments are for rendering the disclosure of the present invention complete and are set forth to provide a complete understanding of the scope of the invention to a person with ordinary skill in the technical field to which the present invention pertains, and the present invention will only be defined by the scope of the claims. Like reference numerals indicate like elements throughout the specification.

Hereinafter, a lighting apparatus for a vehicle according to exemplary embodiments of the present invention will be described with reference to the drawings.

The lighting apparatus for a vehicle may be modified by those skilled in the art, and in the present exemplary embodiment, the lighting apparatus for a vehicle will be described.

Figure 2:
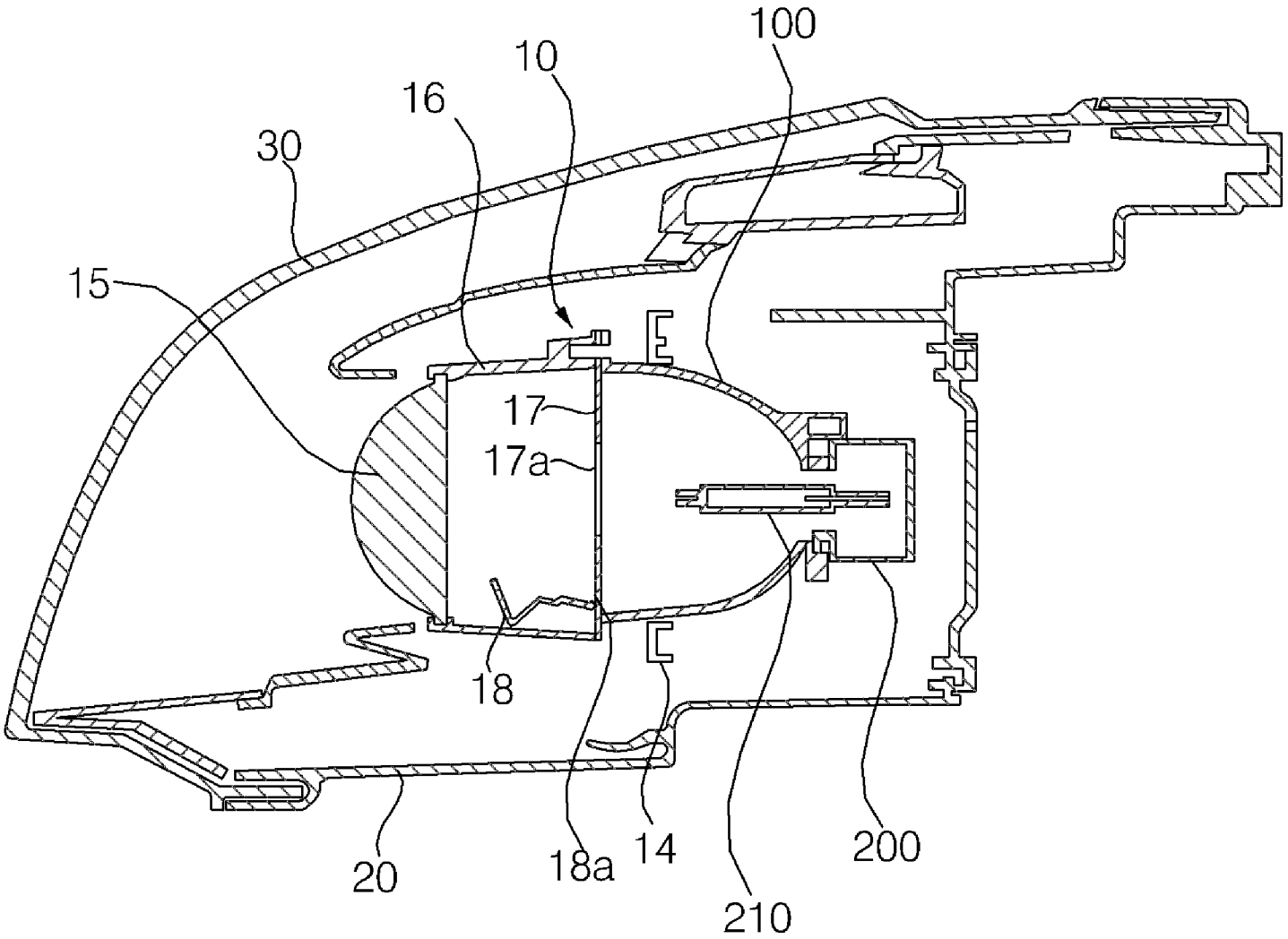
FIG. 2 is a cross-sectional side view illustrating a state in which the headlamp for a vehicle according to the present invention operates in a high-beam mode.

FIG. 1 is a cross-sectional side view illustrating a state in which a headlamp for a vehicle according to the present invention operates in a low-beam mode, and FIG. 2 is a cross-sectional side view illustrating a state in which the headlamp for a vehicle according to the present invention operates in a high-beam mode.

Referring to FIGS. 1 and 2, the headlamp for a vehicle according to the exemplary embodiment of the present invention includes a lighting module 10 in which a light source 210 is disposed, a lighting module housing 20 which accommodates therein the lighting module 10, and an outer lens 30 which is coupled to a front side of the lighting module housing 20. The lighting module housing 20 is formed to have a structure with a vacant internal space, and opened at the front side thereof. The lighting module 10 is inserted into the vacant interior of the lighting module housing 20 through the front open side of the lighting module housing 20, and thereafter, the outer lens 30 is coupled to the front side of the lighting module housing 20 while shielding the front open side of the lighting module housing 20.

The lighting module housing 20 is inserted into a front side of the vehicle, and mounted on a vehicle body. That is, the lighting apparatus for a vehicle according to the exemplary embodiment of the present invention is used as the headlamp for a vehicle.

The lighting module 10 includes a bulb 210 which generates light, a reflector 100 which accommodates the bulb 210, a lens 15 which is disposed in front of the reflector 100, and a lens holder 16 which is disposed between the reflector 100 and the lens 15 and couples the lens 15 to the reflector 100.

The bulb 210 is disposed in the lighting module 10. A rear end of the bulb 210 is inserted into a socket 200 and then mounted in the socket 200, and thereafter, the bulb 210 is inserted into the reflector 100 through a bulb insertion hole 111 formed at a rear side of the reflector 100, such that the bulb 210 is disposed in the reflector 100. The socket 200 is coupled to the rear side of the reflector 100, and supports the bulb 210.

The reflector 100 is opened at a front side thereof, and formed to have a structure with a vacant internal space, such that the bulb 210 is accommodated in the vacant internal space. An inner surface of the reflector 100 is formed as a concavely curved surface. A reflective material made of aluminum is deposited on the concavely formed inner surface of the reflector 100. Therefore, a reflective portion is formed by depositing the reflective material on the inner surface of the reflector 100, and the reflective portion reflects light, which is generated by the bulb 210, toward the lens 15 disposed in front of the reflector 100. An outer circumferential surface of the reflector 100 may be surrounded by a reflector support bracket 14.

The lens 15 is opened at a rear side thereof, and formed to have a structure with a vacant internal space. The lens 15 has a curved surface that convexly protrudes forward. The lens 15 distributes light reflected by the reflector 100 to the outside. The light, which is distributed to the outside by the lens 15, is distributed to the outside of the vehicle through the outer lens 30. A rim at a rear open side of the lens 15 is coupled to a front side of the lens holder 16.

The lens holder 16 is formed to have a structure with a vacant internal space. The lens 15 is coupled to the front side of the lens holder 16. The lens holder 16 is disposed in front of the reflector 13. The internal space of the lens holder 16 becomes a passage through which light reflected by the reflector 100 passes. That is, light is reflected by the reflector 100 toward the lens 15 while passing through the internal space of the lens holder 16 without being dispersed in a peripheral direction.

The lighting module 10 further includes a shield bracket 17 coupled to the front open side of the reflector 100. The shield bracket 17 is coupled between the reflector 100 and the lens holder 16.

A light passing hole 17*a*, through which the light reflected by the reflector 100 passes, is formed in the shield bracket 17. A part of the light reflected by the reflector 100 is blocked by the shield bracket 17, and the remaining light passes through the light passing hole 17*a*.

A shield 18, which opens and closes a lower portion of the light passing hole 17*a*, is installed on the shield bracket 17. The shield 18 is coupled to a rotating shaft 18*a* rotatably coupled to the shield bracket 17 disposed at a lower side of the light passing hole 17*a*. When the rotating shaft 18*a* is rotated by driving power from a motor (not illustrated), the shield 18 opens and closes the lower portion of the light passing hole 17*a* while being rotated together with the rotating shaft 18*a*.

As illustrated in FIG. 1, when the shield 18 covers the lower portion of the light passing hole 17*a*, light, which is reflected by a portion of the reflector 100 which is disposed at an upper side based on the light source 11, passes through an upper portion of the light passing hole 17*a* and then goes to a lower portion of the lens 15, and light, which is reflected by a portion of the reflector 100 which is disposed at a lower side based on the bulb 210, passes through the lower portion of the light passing hole 17*a*, and then is blocked by the shield 18, such that the light does not go to an upper portion of the lens 15, and as a result, light distributed to the outside of the vehicle is in a low-beam mode.

As illustrated in FIG. 2, when the shield 18 fully opens the light passing hole 17*a*, the light, which is reflected by the portion of the reflector 100 which is disposed at the upper side based on the bulb 210, passes through the upper portion of the light passing hole 17*a* and goes to the lower portion of the lens 15, and the light, which is reflected by the portion of the reflector 100 which is disposed at the lower side based on the bulb 210, passes through the lower portion of the light passing hole 17*a* and then goes to the upper portion of the lens 15, and as a result, light distributed to the outside of the vehicle is in a high-beam mode.

Figure 3:
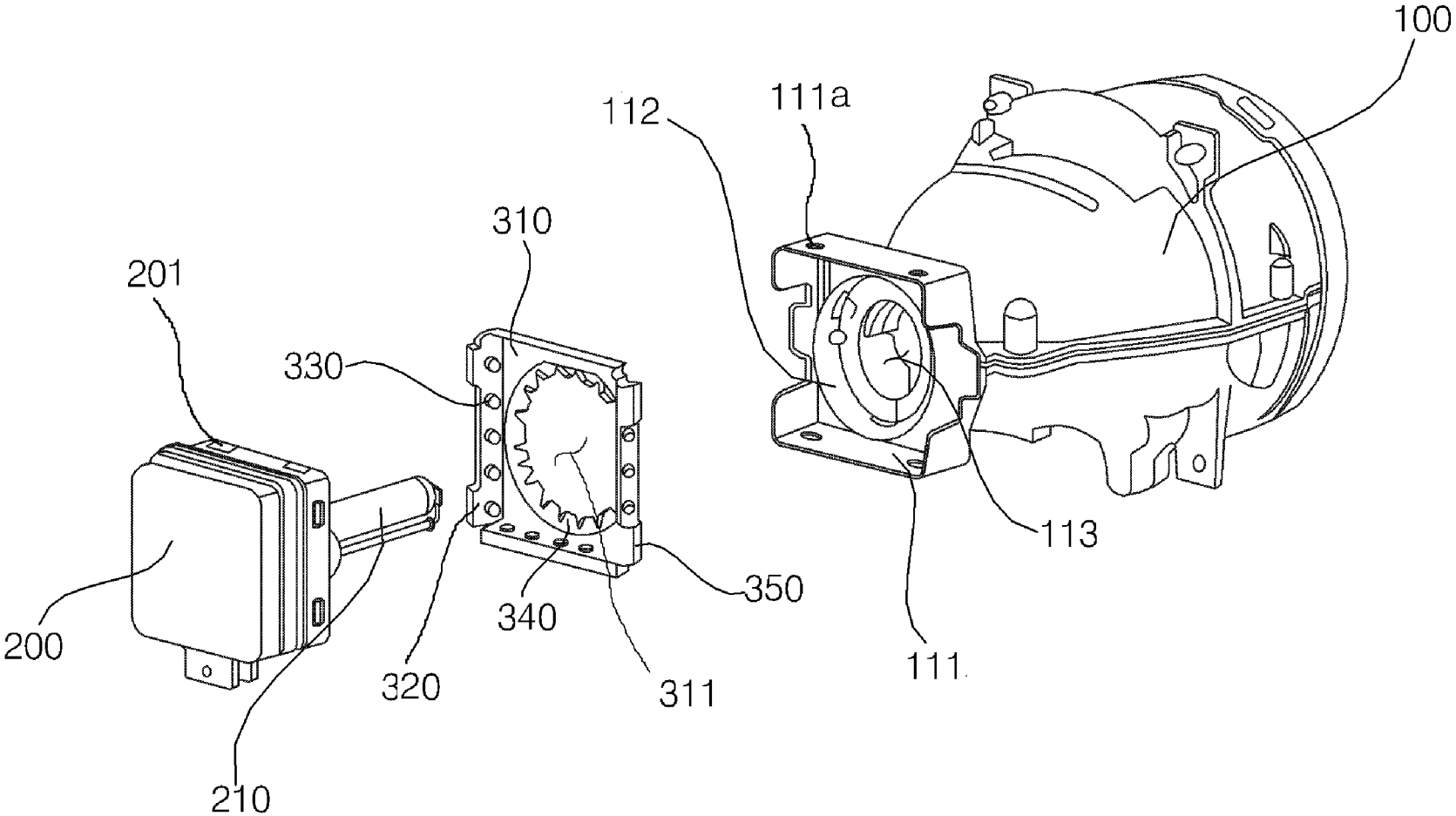
FIG. 3 is a perspective view illustrating a lighting apparatus for a vehicle according to the present invention.
Figure 4:
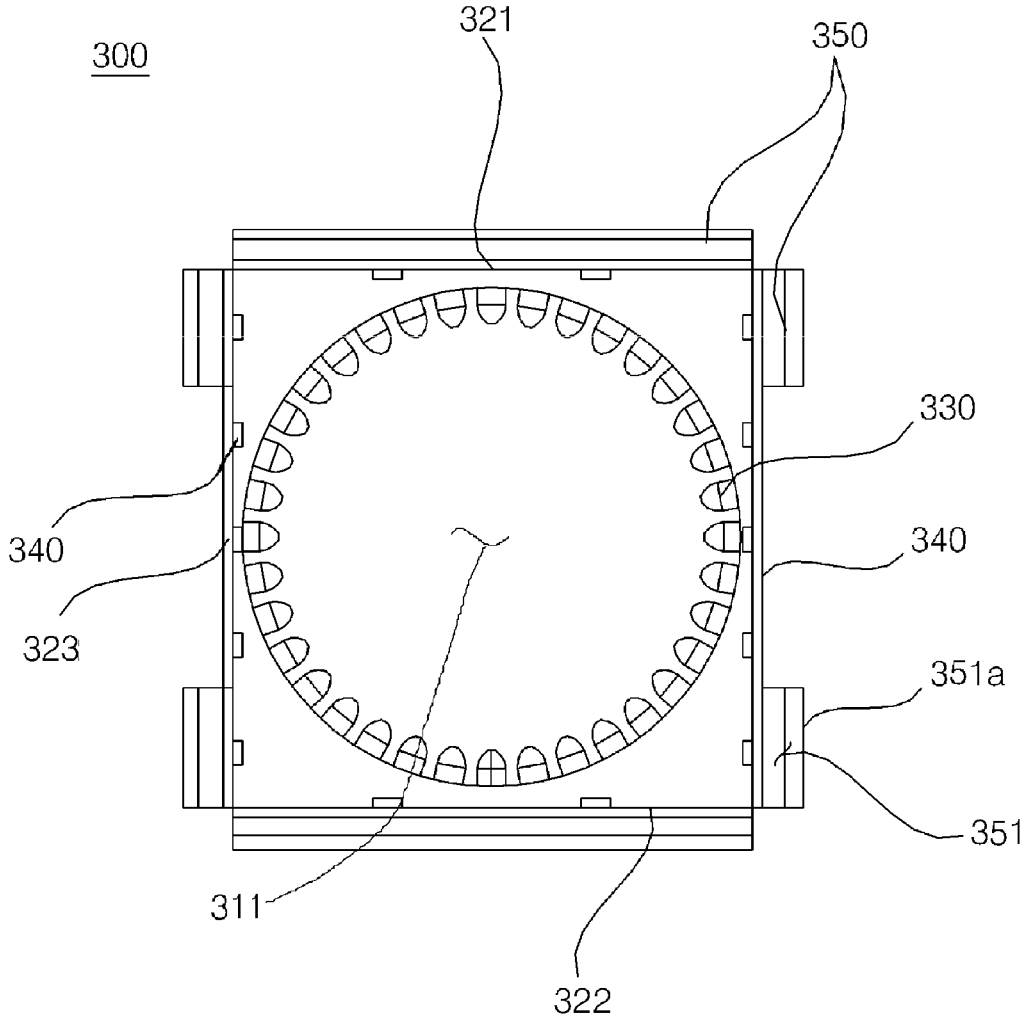
FIG. 4 is a front view of an electromagnetic shield among configurations in FIG. 1.
Figure 5:
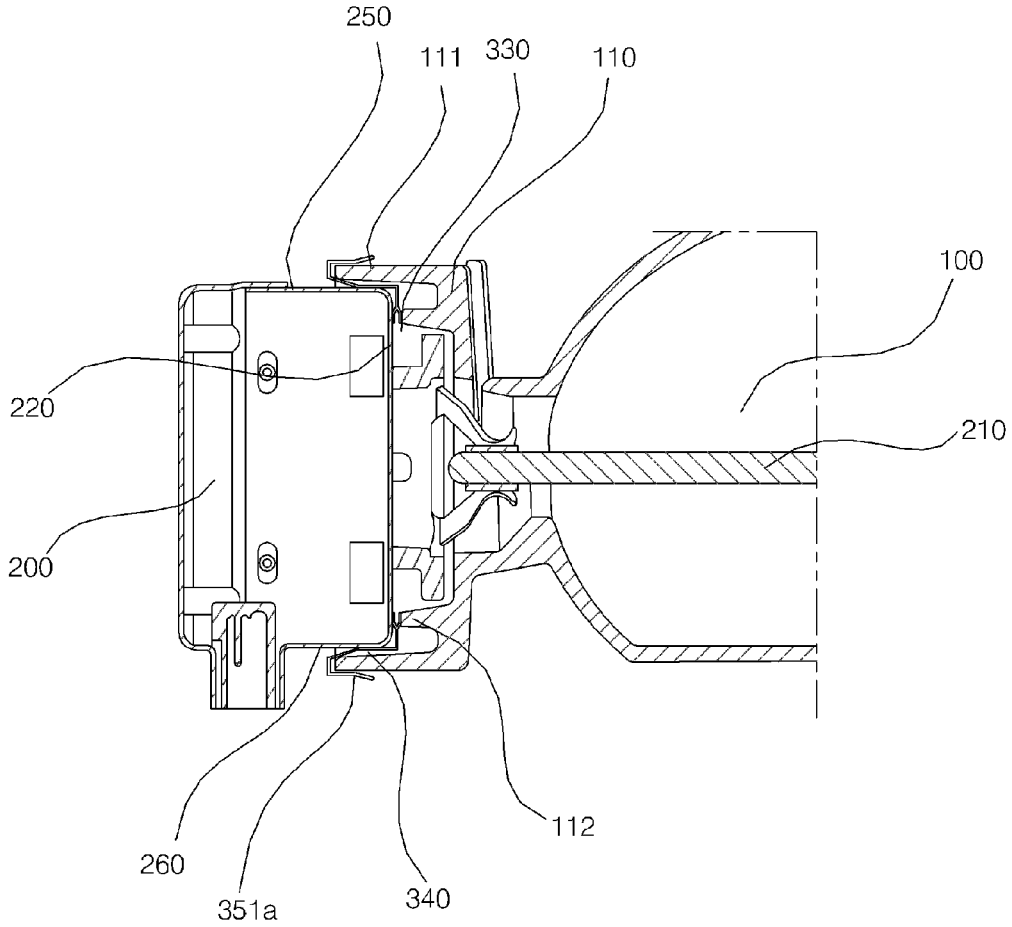
FIG. 5 is a cross-sectional coupled view illustrating the lighting apparatus for a vehicle according to the present invention.
Figure 6:
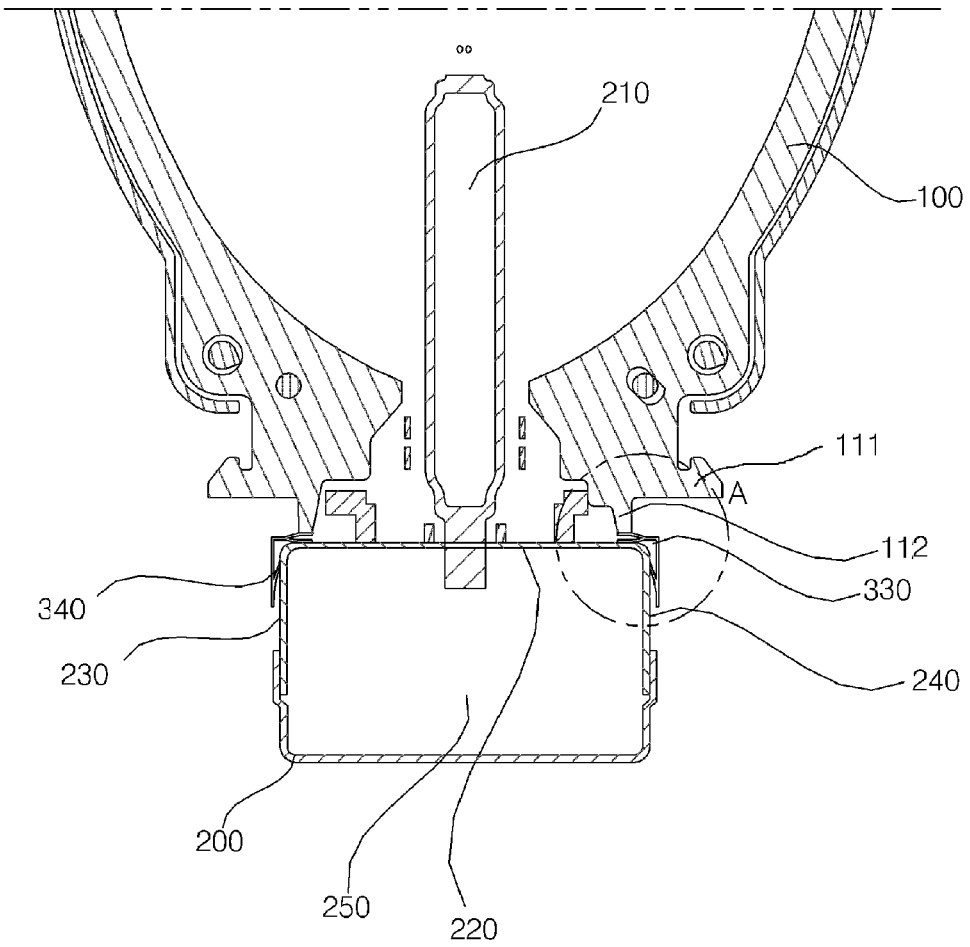
FIG. 6 is a top plan view illustrating the lighting apparatus for a vehicle according to the present invention.
Figure 7:
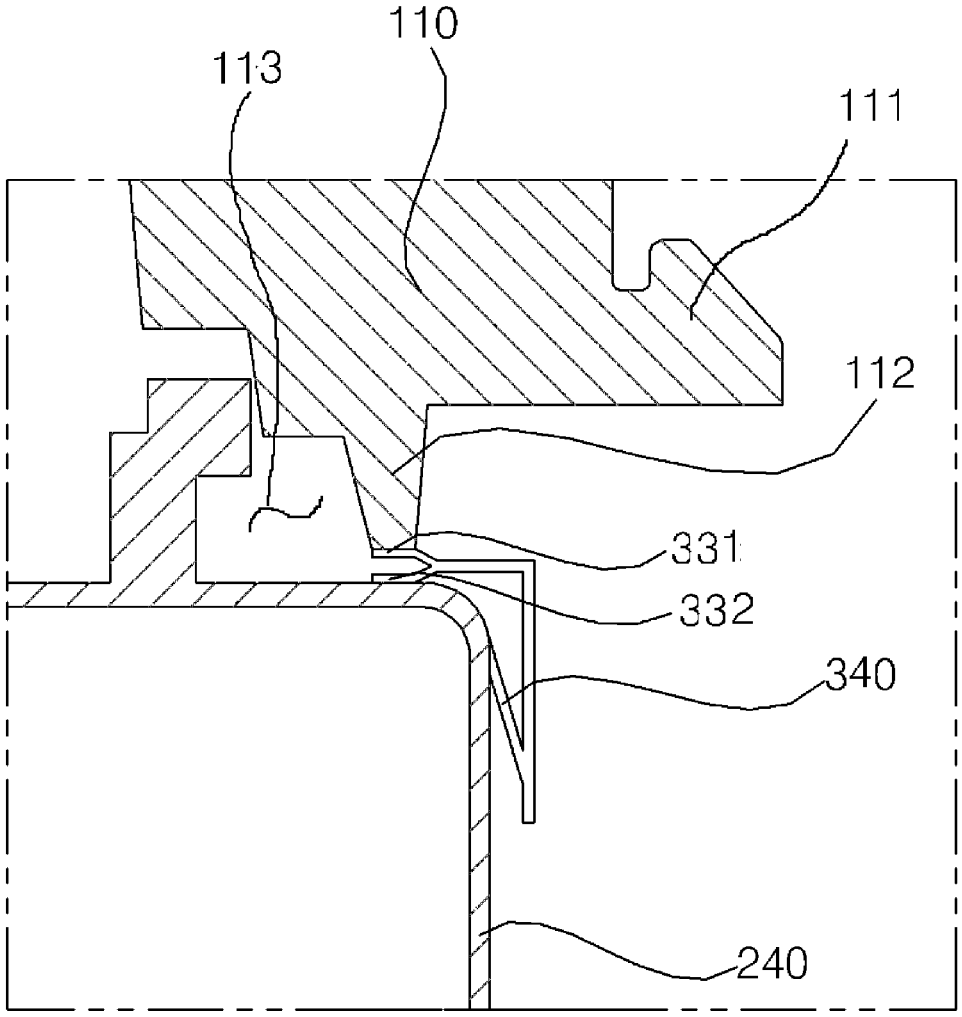
FIG. 7 is an enlarged view of part A illustrated in FIG. 4.
Figure 8:
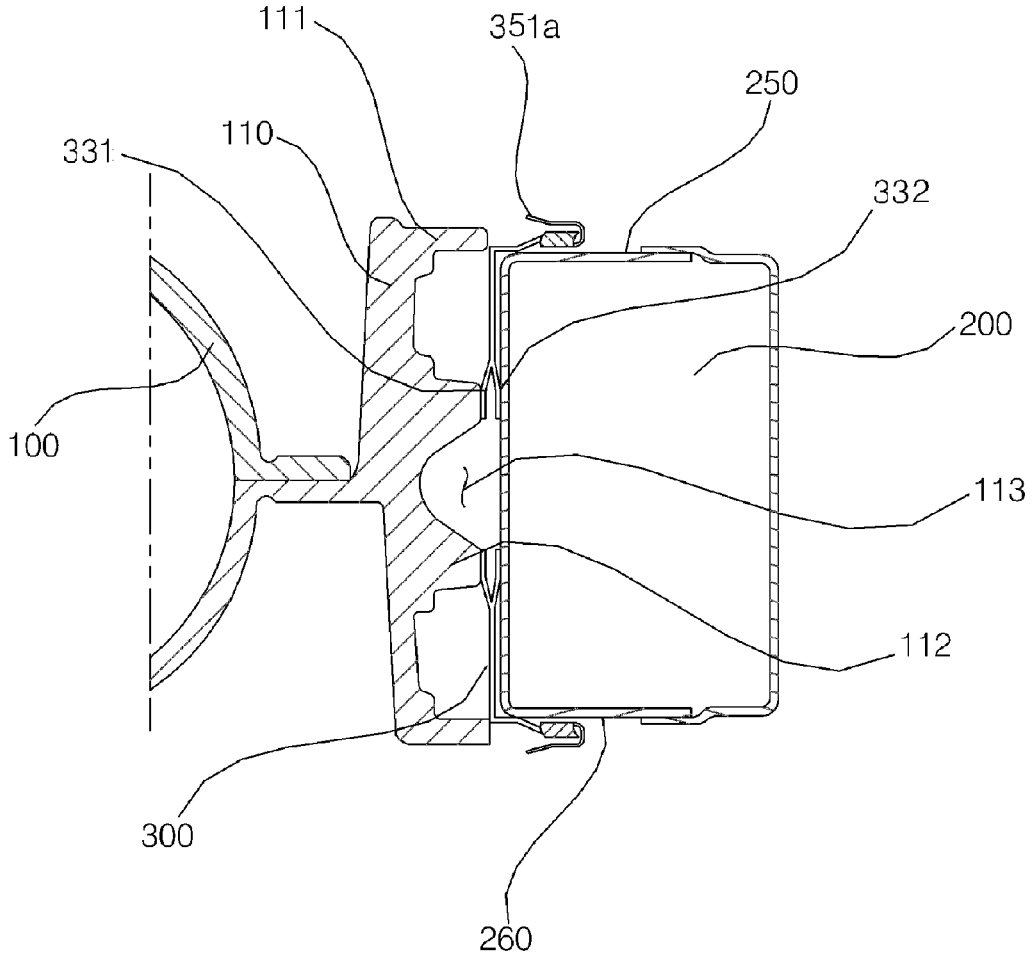
FIG. 8 is a cross-sectional side view illustrating the lighting apparatus for a vehicle according to the present invention.

FIG. 3 is a perspective view illustrating a lighting apparatus for a vehicle according to the present invention, FIG. 4 is a front view of an electromagnetic shield among configurations in FIG. 1, FIG. 5 is a cross-sectional coupled view illustrating the lighting apparatus for a vehicle according to the present invention, and FIG. 6 is a top plan view illustrating the lighting apparatus for a vehicle according to the present invention.

Referring to FIGS. 3 to 6, the lighting apparatus for a vehicle according to the exemplary embodiment of the present invention includes: the bulb 210 which generates light; the socket 200 in which the bulb 210 is mounted; the reflector 100 which has a socket coupling unit 110 to which the socket 200 is coupled, allows the bulb 210 to be inserted into the reflector 100, and reflects forward light generated by the bulb 210; and an electromagnetic shield 300 which is disposed between the socket 200 and the socket coupling unit 110, and has a bulb through hole 311 which the bulb 210 penetrates, and first ground contact protrusions 330, which protrude toward a center of the bulb through hole 311 and come into ground contact with the socket 200 and the socket coupling unit 110, are formed on a portion of the electromagnetic shield 300 where the bulb through hole 311 is formed.

The reflector 100 may serve to reflect light emitted from the bulb 210, that is, the light source, such that the light is directed in a predetermined direction. The reflector 100 may have an elliptical shape so that the reflected light is collected at one point and then enters the lens 15.

The socket coupling unit 110 may be formed at one end of the reflector 100 integrally with the reflector 100.

The socket coupling unit 110 includes a case portion 111 into which the socket 200 is inserted and coupled and which has a bulb insertion hole 113 into which the bulb 210 is inserted, and a ground contact portion 112 which protrudes rearward inside the case portion 111, has the bulb insertion hole 113 formed therein, and comes into ground contact with the first ground contact protrusions 330.

Hook grooves 111*a* may be formed in an inner surface of the case portion 111, and hook protrusions 201, which are coupled to the hook grooves 111*a*, may be formed on an outer surface of the socket 200.

The socket 200 may be coupled to the socket coupling unit 110, and may be provided with the bulb 210.

Here, the bulb 210 may be a high intensity discharge (HID) bulb. In this case, since light with high brightness and high intensity is emitted by the HID bulb, that is, the light source, a lamp for a vehicle including the HID bulb may be used as a headlamp for a vehicle.

The electromagnetic shield 300 is disposed between the socket 200 and the socket coupling unit 110, and may have the bulb through hole 311 which the bulb 210 penetrates. The first ground contact protrusion 330, which protrude toward the center of the bulb through hole 311 and come into ground contact with the socket 200 and the socket coupling unit 110, may be formed at the portion of the electromagnetic shield 300 where the bulb through hole 311 is formed.

The electromagnetic shield 300 may include a front portion 310 which has the bulb through hole 311, and a side portion 320 which is formed to be bent rearward from a circumference of the front portion 310. Second ground contact protrusions 340, which come into ground contact with a side surface of the socket 200, may be further formed on the side portion 320.

The front portion 310 may be formed in a quadrangular shape, and the side portion 320 may include an upper portion 321 which is disposed at an upper side of the front portion 310, and a lower portion 322 which is disposed at a lower side of the front portion 310.

The front portion 310 may be formed in a quadrangular shape, and may include a left portion 323 which is disposed at a left side of the front portion 310, and a right portion 324 which is disposed at a right side of the front portion 310.

The front portion 310 may be formed in a quadrangular shape, and the side portion 320 may include the upper portion 321 which is disposed at the upper side of the front portion 310, the lower portion 322 which is disposed at the lower side of the front portion 310, the left portion 323 which is disposed at the left side of the front portion 310, and the right portion 324 which is disposed at the right side of the front portion 310.

Guide bars 350, which are bent from the rear side toward the front side and form slots 351 between the guide bars 350 and an outer surface of the side portion 320, are formed on the side portion 320, and a rim of the case portion 111 is inserted into the slots 351, such that the electromagnetic shield 300 is coupled to the case portion 111. A detailed description will be provided below.

The electromagnetic shield 300 is formed to have the same shape as the socket coupling unit 110, and as a result, it is possible to block electromagnetic waves by maximizing a contact area and minimizing a gap when the socket coupling unit 110 and the socket 200 are coupled to each other.

The first ground contact protrusions 330 may be formed in a zigzag shape. More particularly, the first ground contact protrusions 310 are formed in a zigzag shape, and may simultaneously come into ground contact with a front surface 220 formed at the front side of the socket 200 and the socket coupling unit 110. In the present exemplary embodiment, the first ground contact protrusions 330 are formed to be aligned in a circular shape so as to correspond to a shape of the ground contact portion 112 formed in the socket coupling unit 110. In addition, the number of first ground contact protrusions 330 is 38, such that the first ground contact protrusions 330 may come into ground contact with the front surface 220 formed at the front side of the socket 200 and the socket coupling unit 110, but the number of first ground contact protrusions 330 is not limited.

Each of the first ground contact protrusions 330 includes a first ground contact portion 331 which comes into ground contact with the ground contact portion 112, and a second ground contact portion 332 which is spaced rearward apart from the first ground contact portion 331 and comes into ground contact with the front surface 220 of the socket 200.

The first ground contact protrusions 330 are formed on an inner circumference of the bulb through hole 311, and may be formed inward from the bulb through hole 311.

The second ground contact protrusions 340 are provided inside the electromagnetic shield 300, and may be formed on at least one of the upper portion 321, the lower portion 322, the left portion 323, and the right portion 324. In addition, the second ground contact protrusions 340 may protrude toward the inside of the electromagnetic shield 300. In the present exemplary embodiment, the five second ground contact protrusions 340 are provided on each of the left and right portions 323 and 324 of the electromagnetic shield 300, and the two second ground contact protrusions 340 are provided on each of the upper and lower portions 321 and 322 of the electromagnetic shield 300, but the number of second ground contact protrusions 340 is not limited.

The guide bars 350 are formed on the side portion 320 of the electromagnetic shield 300, and bent from the rear side toward the front side, thereby forming the slots 351 between the guide bars 350 and the outer surface of the side portion 320. The slot 351 is formed in a '⊏' shape.

The guide bar 350 may further include an anti-withdrawal portion 351*a* formed on the guide bar 350 so as to prevent the electromagnetic shield 300 from being withdrawn after the electromagnetic shield 300 is coupled to the socket coupling unit 110. The anti-withdrawal portion 351*a* may be movable by a predetermined force. When a user pulls the anti-withdrawal portions 351*a* in a direction opposite to a direction in which the anti-withdrawal portions 351*a* surround the case portion 111, the guide bars 350 are splayed such that the electromagnetic shield 300 may be withdrawn from the socket coupling unit 110.

According to the exemplary embodiment of the lighting apparatus for a vehicle according to the present invention, which is configured as described above, there may be obtained advantages that it is possible to effectively shield electromagnetic waves, easily assemble the lighting apparatus, and prevent the electromagnetic shield from being withdrawn when the bulb is replaced.

The lighting apparatus for a vehicle according to the exemplary embodiments is not limited by the configurations and methods disclosed in the aforementioned exemplary embodiments, and the entirety or parts of the exemplary embodiments may be selectively combined so that various modifications may be made to the exemplary embodiments.

While the exemplary embodiments of the present invention have been illustrated and described above, the present invention is not limited to the aforementioned specific exemplary embodiments, various modifications may be made by a person with ordinary skill in the technical field to which the present invention pertains without departing from the subject matters of the present invention that are claimed in the claims, and these modifications should not be appreciated individually from the technical spirit or prospect of the present invention.

What is claimed is:

1. A lighting apparatus for a vehicle, comprising:
- a bulb which generates light;
- a socket in which the bulb is mounted;
- a reflector which has a socket coupling unit to which the socket is coupled, allows the bulb to be inserted into the reflector, and reflects forward light generated by the bulb; and
- an electromagnetic shield which is disposed between the socket and the socket coupling unit, and has a bulb through hole which the bulb penetrates,
- wherein first ground contact protrusions, which protrude toward a center of the bulb through hole and come into ground contact with the socket and the socket coupling unit, are formed on a portion of the electromagnetic shield where the bulb through hole is formed, and
- wherein the electromagnetic shield includes:
  - a front portion which has the bulb through hole; and
  - a side portion which is bent rearward from a circumference of the front portion.

2. The lighting apparatus of claim 1, wherein second ground contact protrusions, which come into ground contact with a side surface of the socket, are further formed on the side portion.

3. The lighting apparatus of claim 1, wherein the front portion is formed in a quadrangular shape, and
- the side portion includes:
- an upper portion which is disposed at an upper side of the front portion; and
- a lower portion which is disposed at a lower side of the front portion.

4. The lighting apparatus of claim 1, wherein the front portion is formed in a quadrangular shape, and
- the side portion includes:
- a left portion which is disposed at a left side of the front portion; and
- a right portion which is disposed at a right side of the front portion.

5. The lighting apparatus of claim 1, wherein the front portion is formed in a quadrangular shape, and
- the side portion includes:
- an upper portion which is disposed at an upper side of the front portion;
- a lower portion which is disposed at a lower side of the front portion;
- a left portion which is disposed at a left side of the front portion; and
- a right portion which is disposed at a right side of the front portion.

6. The lighting apparatus of claim 1, wherein the socket coupling unit includes:
- a case portion into which the socket is inserted and coupled and which has a bulb insertion hole into which the bulb is inserted; and
- a ground contact portion which protrudes rearward inside the case portion, has the bulb insertion hole formed therein, and comes into ground contact with the first ground contact protrusions.

7. The lighting apparatus of claim 6, wherein hook grooves are formed in an inner surface of the case portion, and hook protrusions, which are coupled to the hook grooves, are formed on an outer surface of the socket.

8. The lighting apparatus of claim 6, wherein guide bars, which are bent from the rear side toward the front side and form slots between the guide bars and an outer surface of the side portion, are formed on the side portion, and a rim of the case portion is inserted into the slots, such that the electromagnetic shield is coupled to the case portion.

9. The lighting apparatus of claim 6, wherein the first ground contact protrusions includes:

a first ground contact portion which comes into ground contact with the ground contact portion; and a second ground contact portion which is spaced rearward apart from the first ground contact portion and comes into ground contact with a front surface of the socket.

10. The lighting apparatus of claim 9, wherein the second ground contact portion is spaced apart from the first ground contact portion.

* * * * *